US010968713B2

(12) United States Patent
Harrigan et al.

(10) Patent No.: US 10,968,713 B2
(45) **Date of Patent: *Apr. 6, 2021**

(54) SYSTEM AND METHOD FOR PROVIDING OSCILLATION DOWNHOLE

(71) Applicant: Schlumberger Technology Corporation, Sugar Land, TX (US)

(72) Inventors: Edward Harrigan, Richmond, TX (US); Jahir Pabon, Newton, MA (US); Satish Kumar, Sugar Land, TX (US); Sashank Vasireddy, Stafford, TX (US); Murat Ocalan, Boston, MA (US); Shunfeng Zheng, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 478 days.

This patent is subject to a terminal disclaimer.

(21) Appl. No.: 15/291,102

(22) Filed: Oct. 12, 2016

(65) Prior Publication Data

US 2017/0030158 A1 Feb. 2, 2017

Related U.S. Application Data

(63) Continuation of application No. 13/722,992, filed on Dec. 20, 2012, now Pat. No. 9,470,055.

(51) Int. Cl.
*E21B 28/00* (2006.01)
*E21B 4/06* (2006.01)
(Continued)

(52) U.S. Cl.
CPC ..... *E21B 28/00* (2013.01); *E21B 4/06* (2013.01); *E21B 7/24* (2013.01); *E21B 31/005* (2013.01);
(Continued)

(58) Field of Classification Search
CPC ..... E21B 4/06; E21B 7/24; E21B 28/00
See application file for complete search history.

(56) References Cited

U.S. PATENT DOCUMENTS 1,612,889 A 1/1927 Smith
2,911,192 A * 11/1959 Boucher ..... E21B 7/24 175/105
(Continued)

FOREIGN PATENT DOCUMENTS

GB 2275342 A 8/1994
GB 2315788 A 2/1998
(Continued)

OTHER PUBLICATIONS

Castaneda, et al., "Coiled Tubing Milling Operations: Successful Application of an Innovative Variable Water Hammer Extended-Reach BHA to Improve End Load Efficiencies of a PDM in Horizontal Wells", SPE 143346—SPE/ICoTA Coiled Tubing Conference & Well Intervention Conference and Exhibition, The Woodlands, Texas, USA, Apr. 5-6, 2011, pp. 1-19.
(Continued)

*Primary Examiner* — Tara Schimpf
(74) *Attorney, Agent, or Firm* — Eileen Pape

(57) ABSTRACT

A technique employs the use of oscillations downhole to facilitate a desired functionality of a downhole tool. According to this technique, a tool is initially conveyed downhole and operated to perform a function that relates to a downhole application. The operational efficiency of the tool is improved by creating oscillating forces which vibrate the tool to achieve a desired result, e.g. freeing the tool from a stuck position.

14 Claims, 13 Drawing Sheets

(51) Int. Cl.

| | |
|---|---|
| ***E21B 7/24*** | (2006.01) |
| ***E21B 31/00*** | (2006.01) |
| ***E21B 47/00*** | (2012.01) |
| *E21B 47/07* | (2012.01) |
| *E21B 47/06* | (2012.01) |
| *E21B 47/12* | (2012.01) |

(52) U.S. Cl.
CPC ..... *E21B 47/00* (2013.01); *E21B 47/06* (2013.01); *E21B 47/07* (2020.05); *E21B 47/12* (2013.01)

(56) References Cited

U.S. PATENT DOCUMENTS

| | | | | |
|---|---|---|---|---|
| 3,076,153 | A | 1/1963 | Rieckman | |
| 3,155,163 | A | 11/1964 | Bodine, Jr. | |
| 3,307,636 | A * | 3/1967 | Le Blanc | E21B 31/113 173/13 |
| 3,703,104 | A | 11/1972 | Tamplen | |
| 3,810,425 | A | 5/1974 | Post | |
| 3,976,132 | A | 8/1976 | Harper, Jr. | |
| 4,384,625 | A | 5/1983 | Roper et al. | |
| 4,497,381 | A | 2/1985 | Dickinson, III et al. | |
| 4,574,888 | A | 3/1986 | Vogen | |
| 4,576,229 | A | 3/1986 | Brown | |
| 4,629,012 | A | 12/1986 | Schuh | |
| 4,658,901 | A * | 4/1987 | Alexander | E21B 31/18 166/178 |
| 4,667,742 | A | 5/1987 | Bodine | |
| 4,736,797 | A | 4/1988 | Restarick et al. | |
| 4,776,397 | A | 10/1988 | Akkerman | |
| 4,890,682 | A | 1/1990 | Worrall et al. | |
| 4,913,234 | A | 4/1990 | Bodine | |
| 5,117,685 | A | 6/1992 | Goldschild | |
| 5,309,405 | A | 5/1994 | Brett et al. | |
| 5,448,911 | A | 9/1995 | Mason | |
| 5,454,420 | A | 10/1995 | Snider et al. | |
| 5,469,925 | A | 11/1995 | Mueller et al. | |
| 5,785,125 | A | 7/1998 | Royer | |
| 6,009,948 | A | 1/2000 | Flanders et al. | |
| 6,079,505 | A | 6/2000 | Pignard et al. | |
| 6,135,206 | A | 10/2000 | Gano et al. | |
| 6,152,222 | A | 11/2000 | Kyllingstad | |
| 6,412,560 | B1 | 7/2002 | Bernat | |
| 6,439,318 | B1 | 8/2002 | Eddison et al. | |
| 6,464,014 | B1 | 10/2002 | Bernat | |
| 6,497,290 | B1 | 12/2002 | Misselbrook et al. | |
| 6,550,536 | B2 | 4/2003 | Bernat | |
| 6,571,870 | B2 | 6/2003 | Zheng et al. | |
| 6,845,818 | B2 | 1/2005 | Tutuncu et al. | |
| 6,907,927 | B2 | 6/2005 | Zheng et al. | |
| 7,139,219 | B2 | 11/2006 | Kollé et al. | |
| 7,219,726 | B2 | 5/2007 | Zheng et al. | |
| 7,225,887 | B2 | 6/2007 | Kriesels | |
| 7,293,614 | B2 | 11/2007 | Rose | |
| 7,458,267 | B2 | 12/2008 | McCoy | |
| 7,575,051 | B2 | 8/2009 | Stoesz et al. | |
| 7,637,321 | B2 | 12/2009 | Zazovsky et al. | |
| 7,690,423 | B2 | 4/2010 | Del Campo et al. | |
| 7,703,318 | B2 | 4/2010 | Jacobson et al. | |
| 7,708,088 | B2 | 5/2010 | Allahar et al. | |
| 7,757,793 | B2 | 7/2010 | Voronin et al. | |
| 7,849,924 | B2 | 12/2010 | Surjaatmadja et al. | |
| 7,874,362 | B2 | 1/2011 | Coates et al. | |
| 7,894,297 | B2 | 2/2011 | Nutt et al. | |
| 8,039,422 | B1 | 10/2011 | Al-Zahrani | |
| 8,042,623 | B2 | 10/2011 | Quernheim et al. | |
| 8,636,062 | B2 | 1/2014 | Fripp et al. | |
| 8,714,269 | B2 | 5/2014 | Brennan, III | |
| 2001/0040379 | A1 * | 11/2001 | Schultz | E21B 28/00 290/1 R |
| 2005/0092484 | A1 * | 5/2005 | Evans | E21B 31/107 166/178 |
| 2005/0155758 | A1 | 7/2005 | Webb et al. | |
| 2005/0178558 | A1 | 8/2005 | Kolle et al. | |
| 2005/0230101 | A1 | 10/2005 | Zheng et al. | |
| 2005/0257931 | A1 | 11/2005 | Mody et al. | |
| 2005/0284624 | A1 | 12/2005 | Libby et al. | |
| 2006/0054315 | A1 | 3/2006 | Newman | |
| 2006/0101914 | A1 | 5/2006 | McCoy | |
| 2006/0185905 | A1 | 8/2006 | Haughom | |
| 2007/0024126 | A1 | 2/2007 | Brennvall | |
| 2007/0256828 | A1 | 11/2007 | Birchak et al. | |
| 2007/0289778 | A1 * | 12/2007 | Watkins | E21B 28/00 175/40 |
| 2008/0073085 | A1 | 3/2008 | Lovell et al. | |
| 2008/0099245 | A1 * | 5/2008 | Hall | E21B 4/06 175/57 |
| 2008/0115972 | A1 | 5/2008 | Lynde et al. | |
| 2008/0251254 | A1 | 10/2008 | Lynde et al. | |
| 2009/0166026 | A1 | 7/2009 | Akselberg | |
| 2009/0260822 | A1 | 10/2009 | Stoesz et al. | |
| 2009/0314486 | A1 | 12/2009 | Castro | |
| 2010/0276204 | A1 | 11/2010 | Connell et al. | |
| 2011/0036560 | A1 * | 2/2011 | Vail, III | E21B 28/00 166/87.1 |
| 2011/0120772 | A1 | 5/2011 | McLoughlin et al. | |
| 2011/0139445 | A1 | 6/2011 | Fripp et al. | |
| 2011/0139510 | A1 | 6/2011 | Declute-Melancon | |
| 2011/0180265 | A1 | 7/2011 | Shand | |
| 2011/0203395 | A1 | 8/2011 | Pfahlert | |
| 2011/0267922 | A1 | 11/2011 | Shampine et al. | |
| 2012/0018145 | A1 | 1/2012 | Wheater et al. | |
| 2012/0024539 | A1 | 2/2012 | Lehr | |
| 2012/0031609 | A1 | 2/2012 | Wheater et al. | |
| 2012/0048621 | A1 | 3/2012 | Stewart et al. | |
| 2012/0132289 | A1 | 5/2012 | Kolle | |
| 2012/0186808 | A1 | 7/2012 | Lively et al. | |
| 2012/0241219 | A1 | 9/2012 | Wiercigroch | |
| 2012/0318531 | A1 | 12/2012 | Shampine et al. | |
| 2013/0061742 | A1 | 3/2013 | Brennan, III | |
| 2013/0062075 | A1 | 3/2013 | Brennan | |
| 2013/0160991 | A1 | 6/2013 | Gregory et al. | |
| 2013/0186619 | A1 | 7/2013 | Wicks et al. | |
| 2013/0199794 | A1 | 8/2013 | Lane et al. | |
| 2014/0069639 | A1 | 3/2014 | Mackenzie et al. | |
| 2014/0174722 | A1 | 6/2014 | Christie et al. | |
| 2014/0251639 | A1 | 9/2014 | Jewett | |
| 2015/0034336 | A1 | 2/2015 | Morrison et al. | |

FOREIGN PATENT DOCUMENTS

| | | | |
|---|---|---|---|
| WO | 9735093 | A1 | 9/1997 |
| WO | 2004072437 | A1 | 8/2004 |
| WO | 2010125405 | A2 | 11/2010 |
| WO | 2011005144 | A1 | 1/2011 |

OTHER PUBLICATIONS

Dupriest, et al., "Design Methodology and Operation Practices Eliminate Differential Sticking", SPE 128129—IADC/SPE Drilling Conference and Exhibition, New Orleans, Louisiana, USA, 2010, pp. 1-13.

Newman, "Vibration and Rotation Considerations in Extending Coiled-Tubing Reach", SPE 106979—SPE/ICoTA Coiled Tubing and Well Intervention Conference and Exhibition, The Woodlands, Texas, U.S.A., 2007, pp. 1-9.

Parry, "Numerical Prediction Method for Growth and Deformation of Filter Cakes", Journal of Fluids Engineering, vol. 128, Nov. 2006, pp. 1259-1265.

Robertson, et al., "Dynamic Excitation Tool: Developmental Testing and CTD Field Case Histories", SPE 89519—SPE/ICoTA Coiled Tubing Conference and Exhibition, Houston, Texas, Mar. 23-24, 2004, pp. 1-16.

Sherwood, "Differential pressure sticking of drill string", AIChE Journal, vol. 44, No. 3, Mar. 1998, pp. 711-721.

Sola, "New Downhole Tool for Coiled Tubing Extended Reach", SPE 60701—SPE/ICoTA Coiled Tubing Roundtable, Houston, Texas, Apr. 5-6, 2000, 8 pages.

(56) References Cited

OTHER PUBLICATIONS

Stoesz, et al., "Low-Frequency Downhole Vibration Technology Applied to Fishing Operations", SPE 63129—SPE Annual Technical Conference and Exhibition, Dallas, Texas, 2000, pp. 1-7.
Gonzalez et al., "Stuck Coiled-Tubing Recovery Utilizing Surface Equipment and Methods", SPE130342, SPE/ICoTA Coiled Tubing and Well Intervention Conference and Exhibtion held in The Woodlands, Texas, Mar. 23-24, 2010, 7 pages.
Joppe et al., "Using High-Frequency Downhold Vibration Technology to Enhance Through-Tubing Fishing and Workover Operations", SPE 99415, SPE/ICoTA Coiled Tubing and Well Intervention Conference and Exhibtion, 2006, 4 pages.
Office Action issued in the RU application 2014134066 dated Jun. 29, 2016 (9 pages).
Office Action issued in the RU application 2014134066 dated Sep. 16, 2016 (9 pages).
Decision on Grant for RU Application No. 2014134066, dated Apr. 21, 2017 with English Translation, (12 pages).
Examination Report issued in the CA application 2861839, dated Sep. 3, 2019 (3 pages).
International Search Report and Written Opinion issued in PCT/US2013/073223 dated Mar. 26, 2014 (12 pages).
International Preliminary Report on Patentability issued in PCT/US2013/073223 dated Jun. 23, 2015 (8 pages).
International Search Report and Written Opinion issued in PCT/US2013/020118 dated Apr. 12, 2013 (10 pages).
International Preliminary Report on Patentability issued in PCT/US2013/020118 dated Jul. 31, 2014 (7 pages).
Dictionary Definition of "groove" accessed Jun. 25, 2015 via www.merriam-Webster.com (4 pages).

* cited by examiner

SYSTEM AND METHOD FOR PROVIDING OSCILLATION DOWNHOLE

CROSS REFERENCE TO RELATED APPLICATIONS

This application is a continuation of U.S. application Ser. No. 13/722,992, filed Dec. 20, 2012, which is incorporated by reference herein in its entirety.

BACKGROUND

In many well applications, downhole tool operation can be susceptible to a variety of parameters which limit the tool with respect to performance of the function for which the tool was designed. For example, tools deployed downhole via wireline can become stuck due to differential sticking or other causes. In tool differential sticking, the differential pressure between the borehole and the formation creates a normal force which effectively causes the downhole tool to adhere to the borehole wall. The tool becomes stuck when the maximum safe wireline cable pull is less than the force sufficient to move the tool axially in the borehole. However, a variety of other factors can limit the movement or progression of a tool in a downhole application.

SUMMARY

In general, a system and methodology are provided for inducing oscillations downhole to facilitate a function of a downhole tool. A tool is initially conveyed downhole and operated to perform a function that relates to a downhole application. The operational efficiency of the tool is improved by creating oscillations which vibrate the tool to achieve a desired result, e.g. freeing the tool from a stuck position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for inducing oscillating forces downhole to facilitate a function of a downhole tool. In a given downhole application, a tool is initially conveyed downhole and operated to perform a function. The operational efficiency of the tool is improved by creating oscillations which vibrate the tool to achieve a desired result. For example, the oscillations may be used to free a stuck tool deployed by a wireline and/or to enhance a drilling function or other function of a downhole tool.

In wireline applications, for example, tools are deployed downhole via wireline and such tools are prone to becoming stuck in the wellbore. In some applications, the wireline tool may become stuck due to differential sticking which results from differential pressure between the wellbore and the surrounding formation, thus creating a normal force that effectively causes the tool to adhere to the borehole wall. Sometimes the wireline tool also may become stuck due to key-seating, friction with a borehole restriction, or other causes that inhibit movement of the wireline tool downhole. The wireline cable itself also can become stuck via similar causes. By inducing suitable oscillating forces to create a larger net peak force, the wireline tool and wireline may be freed for continued movement along the wellbore. The oscillating force or forces may also induce vibration in the wireline tool and the wireline, which may assist in freeing or unsticking the wireline tool. Further, the induced vibration may help de-stabilize and/or fluidize a mud cake layer formed between the wireline tool and the wellbore, which may result from such differential sticking. The oscillating force may be applied or induced in a continuous manner or the oscillating force may be applied as a periodic force, wherein the force is induced in a periodic manner.

The induced oscillations also may be employed to enhance the efficiency of other types of applications, e.g. to enhance a desired movement of a downhole tool. By way of example, the induced oscillating forces may be used in cutting operations, e.g. drilling or milling operations, to enhance a function, e.g. to enhance the rate of penetration and/or to reduce friction with the surrounding wellbore wall. The reduced friction can be used to increase reach and to improve load transfer to the tool, e.g. cutting bit. The oscillations may be induced by a vibrator used in cooperation with wireline cable. However, some applications may utilize the vibrator and the induced oscillating forces with other types of conveyances.

Figure 1:
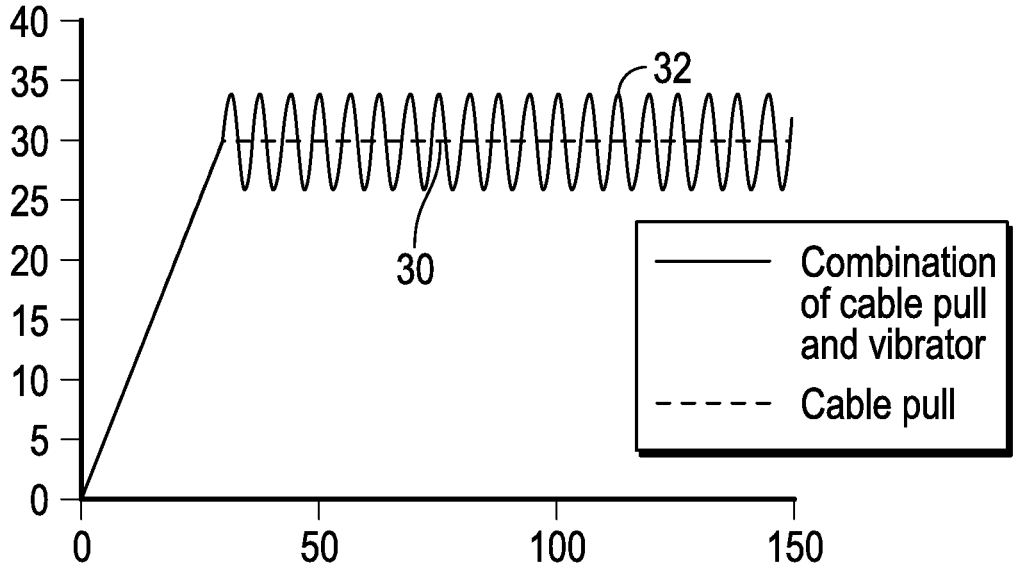
FIG. 1 is a graphical example illustrating the effects of applying an oscillating force to facilitate movement of a downhole tool in a longitudinal direction, according to an embodiment of the disclosure.

Referring generally to FIG. 1, a graphical illustration is provided to facilitate explanation of the utilization of oscillations which are created to act on a downhole tool. The oscillations/vibrations induced by a vibrator may be applied in a variety of applications, including wireline cable applications. By way of example, the vibration may be applied while a cable pull is applied to a wireline cable from the surface. In the graphical example, a pull force exerted by the wireline cable is represented by line 30 and the oscillating forces applied by a suitable vibrator/shaker are represented by oscillating graph line 32. As illustrated, the oscillating forces created by the vibrator cause a larger net peak force (when the oscillation force is in phase with the cable pull force) than can be applied by the cable alone.

Figure 2:
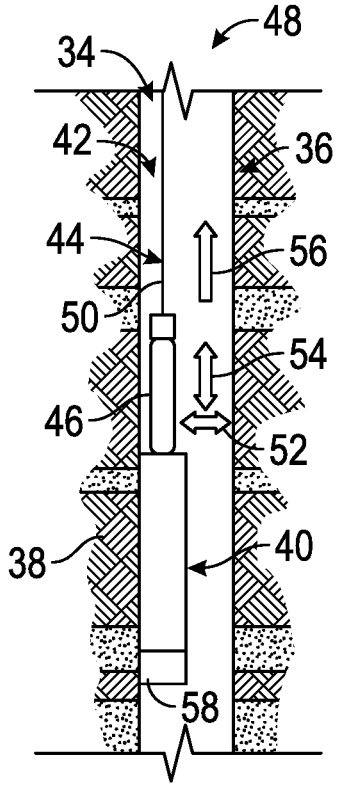
FIG. 2 is a schematic illustration of a well system incorporating a vibrator to apply oscillating forces in a downhole environment, according to an embodiment of the disclosure.

Referring to FIG. 2, a schematic example of a system 34, e.g. a well system for use in a well 36, is illustrated. Well 36 may comprise a production well, an injection well, and/or another type of well drilled into a subterranean formation 38. In the example illustrated, the well system 34 comprises a downhole tool 40 which is deployed into a wellbore 42 via a conveyance 44. Additionally, the well system 34 comprises a vibrator 46, e.g. a shaker mechanism, positioned so that oscillations induced by the vibrator 46 act on the downhole tool 40. By way of example, the vibrator 46 may be mounted proximate tool 40, e.g. directly above or below tool 40. However, some embodiments may position vibrator 46 at a surface location 48, and the vibrator 46 may be designed to utilize a medium, e.g. fluid, to deliver force oscillations downhole through the wellbore 42 to act against downhole tool 40.

By way of example, conveyance 44 may comprise a wireline 50, such as a single strand wireline, e.g. slickline, or a cable wireline, e.g. a cable wireline having insulated communication lines (electrical and/or optical communication lines or the like) disposed within a braided cable. The conveyance 44 may also comprise coiled tubing or jointed pipe or the like. In the example illustrated, the downhole tool 40 has become stuck against a sidewall of wellbore 42 by, for example, differential sticking caused by creation of a normal force 52. Consequently, the maximum safe cable pull is less than the force sufficient to move the tool axially along the wellbore 42. However, the oscillating forces caused by vibrator 46, as represented by arrows 54, create a sufficiently large net peak force to free the downhole tool 40 when the induced oscillation forces acting on downhole tool 40 are in phase with a pull force 56 applied to wireline 50. It should be noted downhole tool 40 may comprise a variety of wellbore tools, including cutting tools used to operate a cutting bit 58, e.g. a drilling or milling bit. The downhole tool 40 may comprise sensors disposed therein, such as pressure, temperature, vibration sensors or the like for gathering measurements from the tool 40 or vibrator 46. The tool 40 may be configured to communicate measurements from the sensors via the conveyance 44 in communication with surface equipment or the like for analysis. The communicated measurements may be utilized for monitoring and/or optimizing the performance and/or the operation of the tool 40 and/or the vibrator 46, such as by making adjustment in tool operation or vibrator operation or the like.

The oscillations induced by vibrator 46 may be caused by a variety of mechanisms and techniques depending on the parameters of a given downhole application. For example, the vibrations/oscillations may be generated by combining a coil and magnet or by utilizing a plurality of coils. In some applications, a motor may be used to rotate an eccentric mass or to rotate a cam mechanism. In other applications, a piezoelectric system, such as a stack of piezoelectric devices, may be used to induce oscillations. Fluid pumps, such as hydraulic pumps, also may be used to induce the oscillations. Sometimes the oscillations may be induced via acoustic impulses created by chemical charges or other types of charges. These and other techniques may be used alone or in combination to provide the desired oscillations/vibrations acting against downhole tool 40 to free or otherwise facilitate movement of the downhole tool 40 along the wellbore 42.

The vibrator 46 also may be operated or swept through a range of frequencies and/or amplitudes. Varying the frequency, for example, allows the system to be tuned to reach or approach resonance where the net force applied will be at a peak value. The resonant frequency can vary based on several criteria, including tool geometry and mass, borehole geometry, temperature, pressure, borehole fluid properties such as density and viscosity, mud cake properties such a shear strength, thickness and acoustic properties, and the position of the tool relative to the borehole geometry. However, the frequency of the oscillations induced by the vibrator 46 can be continually adjusted or swept to move the oscillations toward the resonant frequency of the system. It should be noted that the resonant properties of the system will vary as the downhole tool 40 becomes free, i.e. unstuck, or as the system becomes partially free. The unstuck portion will tend to have a higher frequency but as more of the tool 40 peels away and becomes free the resonant frequency will be reduced. However, the ability to adjust vibrator 46 to change this frequency enables the effects of the induced oscillations acting on the downhole tool 40 to be enhanced. Variations in the amplitude of the oscillations (e.g. variations in oscillation amplitude from low amplitude to high amplitude) also may be used to facilitate movement of the downhole tool 40 in a desired, longitudinal direction.

In some applications, control over the induced oscillations acting on downhole tool 40 can be better controlled by placing the vibrator 46 near a longitudinal end, e.g. the illustrated top end, of the downhole tool 40. In this type of embodiment, the vibrator 46 may be designed with a smaller diameter than the downhole tool 40 to help position the vibrator 46 away from the surrounding wall of wellbore 42. This allows the vibrator 46 to vibrate freely and with a higher Q factor than it would have if it were touching the wellbore wall.

Figure 3:
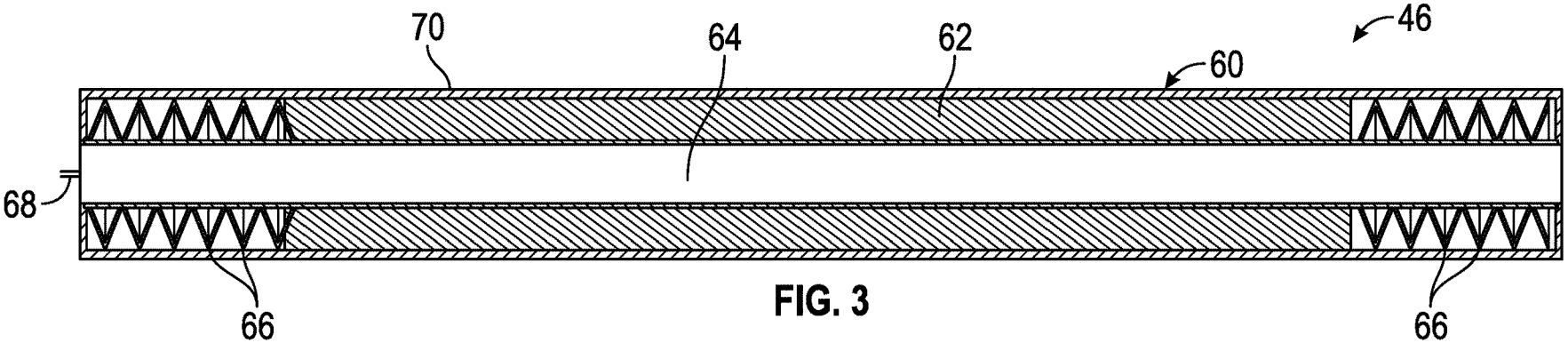
FIG. 3 is an illustration of an example of a vibrator used to apply oscillating forces to a downhole tool, according to an embodiment of the disclosure.
Figure 4:
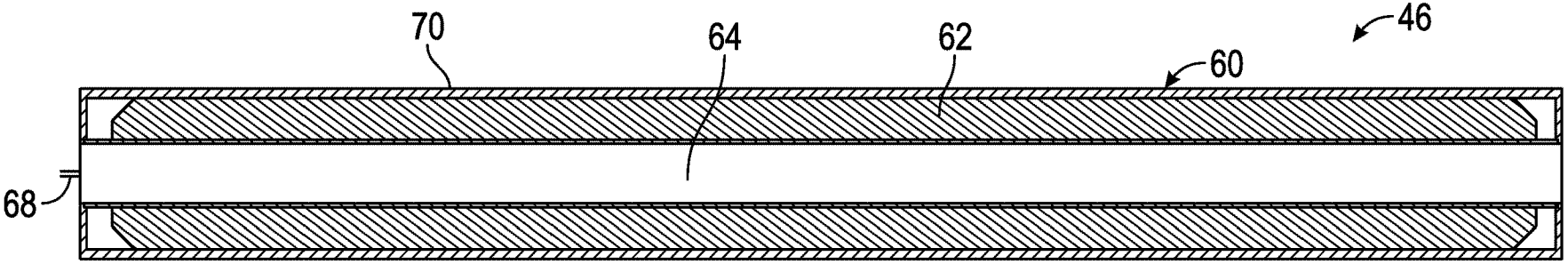
FIG. 4 is an illustration of another example of a vibrator used to apply oscillating forces to a downhole tool, according to an embodiment of the disclosure.

Referring generally to FIG. 3, an example of vibrator 46 is illustrated. In this example, the vibrator 46 is coupled to tool 40 and/or the tool string carrying downhole tool 40 and comprises an electromechanical system 60 which vibrates. The oscillating forces 54 are induced via a vibrating mass 62 mounted about a stator 64 and between springs 66. The vibrating mass 62 may be in the form of a magnet which may be selectively moved along the stator 64 when electrical power is supplied to the system. Additionally, the stator 64 may be designed to enable wiring 68 to pass through the stator 64. When electrical power is supplied to the system via, for example, wiring 68, the mass 62 is induced to vibrate back and forth within a surrounding housing 70 and against springs 66. This motion induces the oscillating forces 54 which act against downhole tool 40 to facilitate longitudinal movement of the downhole tool 40. By way of example, stator 64 may be constructed as a conductive coil and vibrating mass 62 may be constructed as a magnet. In FIG. 4, a similar embodiment of vibrator 46 is illustrated but springs 66 have been removed so that vibrating mass 62 impacts directly against housing 70 which may be directly coupled to downhole tool 40.

Figure 6:
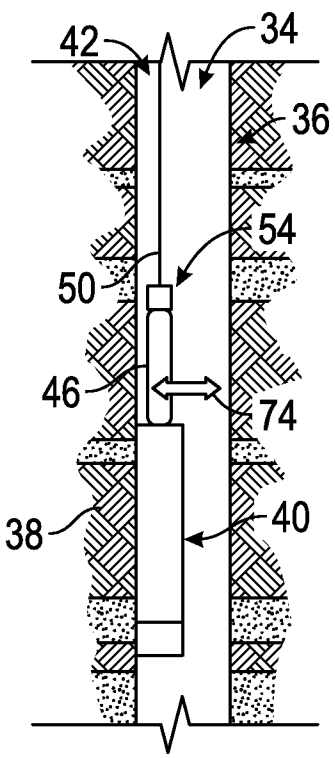
FIG. 6 is a schematic illustration of oscillating forces being applied in a lateral, e.g. radial, direction, according to an embodiment of the disclosure.
Figure 5:
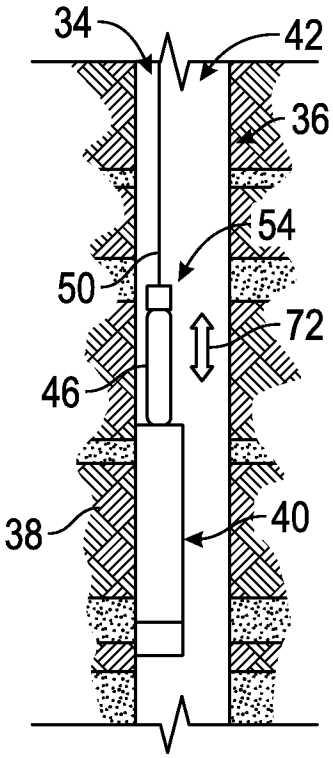
FIG. 5 is a schematic illustration of oscillating forces, i.e. vibrations, being applied in a longitudinal, e.g. axial, direction, according to an embodiment of the disclosure.
Figure 7:
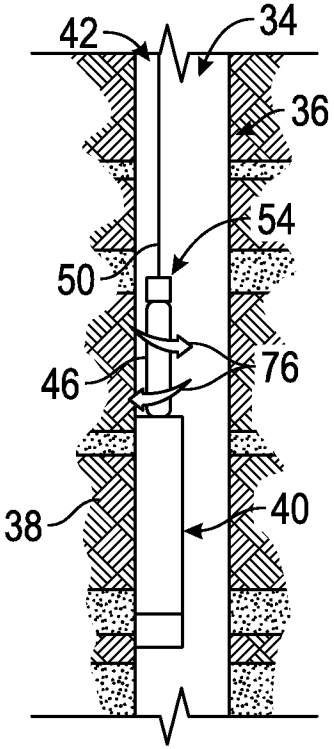
FIG. 7 is a schematic illustration of oscillations being applied as torsional forces, according to an embodiment of the disclosure.

The vibrator 46 may have a variety of constructions, embodiments of which are described herein, and may be oriented to induce a variety of oscillating forces 54. As illustrated in FIG. 5, for example, the vibrator 46 may be designed to induce oscillating forces in a longitudinal, e.g. axial, direction with respect to the wellbore 42, as indicated by arrow 72. The longitudinal forces 72 may be oriented generally axially along the axis of the wireline 50. The vibrator 46 also may be designed to induce oscillating forces 54 in an orthogonal direction with respect to the wellbore 42, as indicated by arrow 74 in FIG. 6. The orthogonal forces 74 may be used in combination with the cable pull to create a force vector which simultaneously pulls away from the wellbore wall and along the wellbore axially. In some embodiments, the vibrator 46 may be designed to induce oscillating forces 54 in the form of torsional forces, e.g. torsional vibrating forces about the axis of downhole tool 40, as illustrated by arrow 76 in FIG. 7 such as by providing cooperating splines and grooves on the mass 62 and/or the stator 64 in order to cause rotation of the 62 or similar features and thereby induce a torsional force from the vibrator 46. Additionally, various combinations of longitudinal forces 72, orthogonal forces 74, and/or torsional forces 76 may be employed to improve tool movement.

Figure 8:
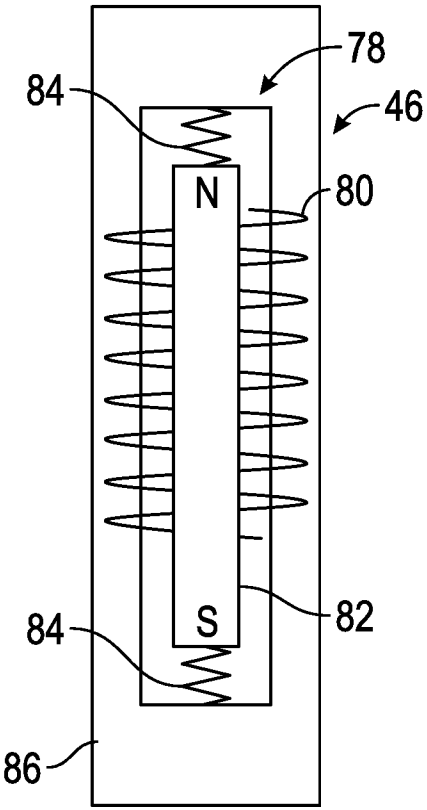
FIG. 8 is an illustration of another example of a vibrator used to apply oscillating forces to a downhole tool, according to an embodiment of the disclosure.

Referring generally to FIG. 8, another embodiment of vibrator 46 is illustrated. In this embodiment, vibrator 46 comprises an electromagnetic mechanism 78 having a conductive coil 80 that can be energized by applying AC power from the surface and through the wireline 50 at various frequencies and amplitudes. The electric coil 80 generates an oscillating magnetic field which applies a sinusoidal force on a magnet assembly 82. In the embodiment illustrated, the oscillating movement of magnet assembly 82 creates a vibrating mass mounted for longitudinal oscillations against springs 84. The magnetic flux lines are in a longitudinal, e.g. axial, direction and the vibrating mass 82 is positioned inside a stator 86. The oscillating forces 54 applied to downhole tool 40 are created by oscillations of the magnet assembly 82 within the conductive coil 80.

Figure 10:
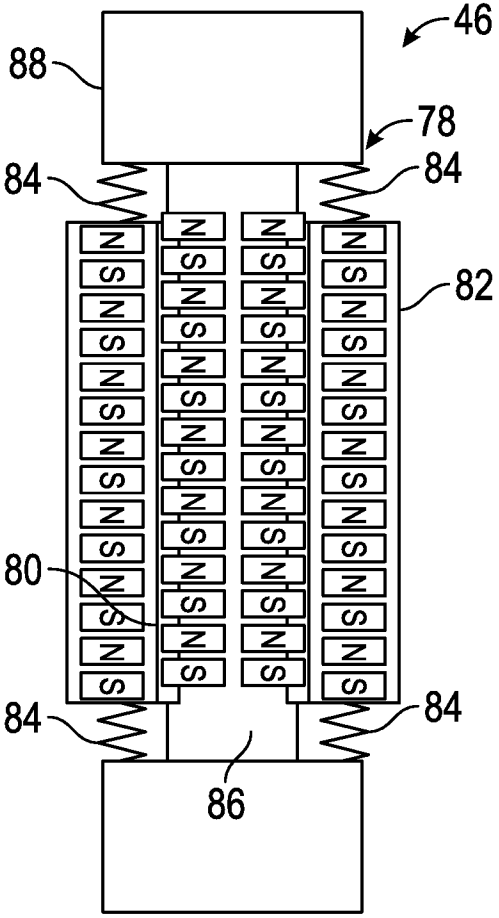
FIG. 10 is an illustration of another example of a vibrator used to apply oscillating forces to a downhole tool, according to an embodiment of the disclosure.
Figure 9:
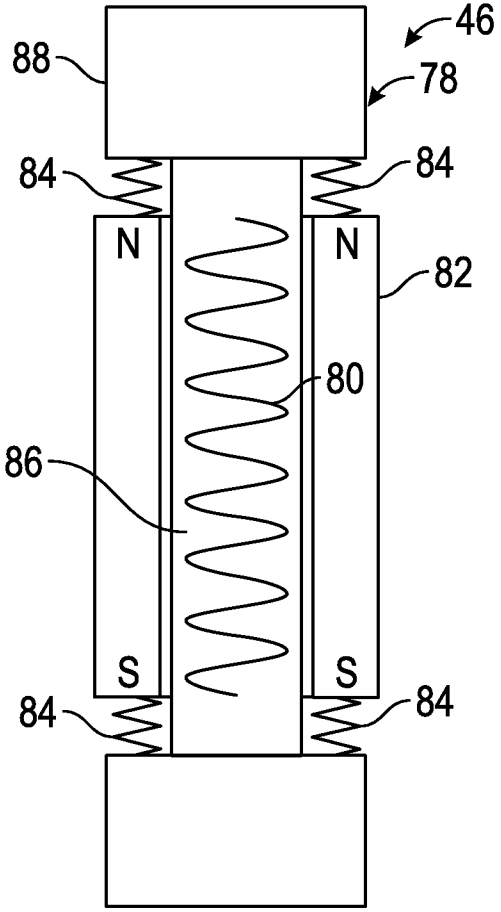
FIG. 9 is an illustration of another example of a vibrator used to apply oscillating forces to a downhole tool, according to an embodiment of the disclosure.

In the embodiment illustrated in FIG. 9, the vibrator 46 also comprises electromagnetic mechanism 78 except the oscillating mass is in the form of an external magnet assembly 82 in which the oscillating magnet is mounted on springs 84 outside of electrically conductive coil 80. Again, coil 80 is powered to generate an oscillating magnetic field which acts on magnet assembly 82 to create an oscillating mass. The oscillating mass, in turn, creates the oscillating forces that induce movement of downhole tool 40. In this embodiment, the stator 86 is positioned within magnet assembly 82. In some applications, the vibrator 46 may be designed such that the oscillating mass/magnet assembly 82 impacts directly against a tool body 88 of downhole tool 40. Additionally, magnet assembly 82 and stator 86 may be arranged to create magnetic flux lines in the transverse or orthogonal direction, as created by the embodiment illustrated in FIG. 10.

Figure 11:
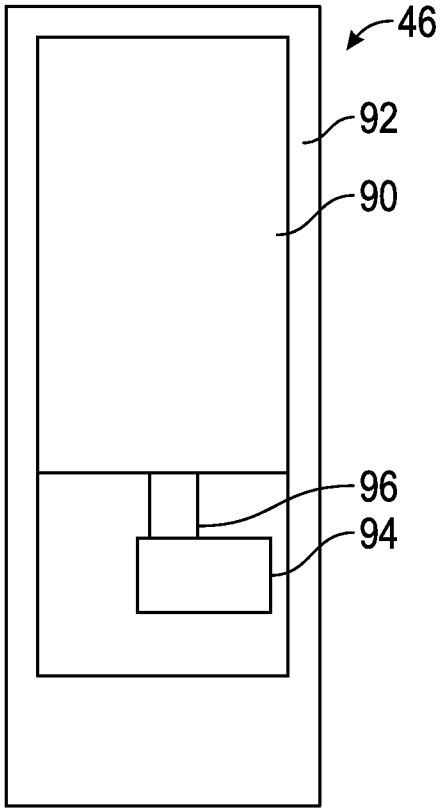
FIG. 11 is an illustration of another example of a vibrator used to apply oscillating forces to a downhole tool, according to an embodiment of the disclosure.

Referring generally to FIG. 11, another embodiment of vibrator 46 is illustrated. In this embodiment, the vibrator 46 comprises a motor 90, such as an electric or hydraulic motor, located in a surrounding housing 92. The motor 90 is coupled to an eccentric mass 94 by a shaft 96. Operation of the motor 90 causes rotation of shaft 96 and eccentric mass 94. The eccentricity of the rotating mass 94 imparts a reactive vibration that induces oscillating forces 54 on the vibrator 46 and these oscillating forces 54 are similarly imparted against downhole tool 40.

Figure 12:
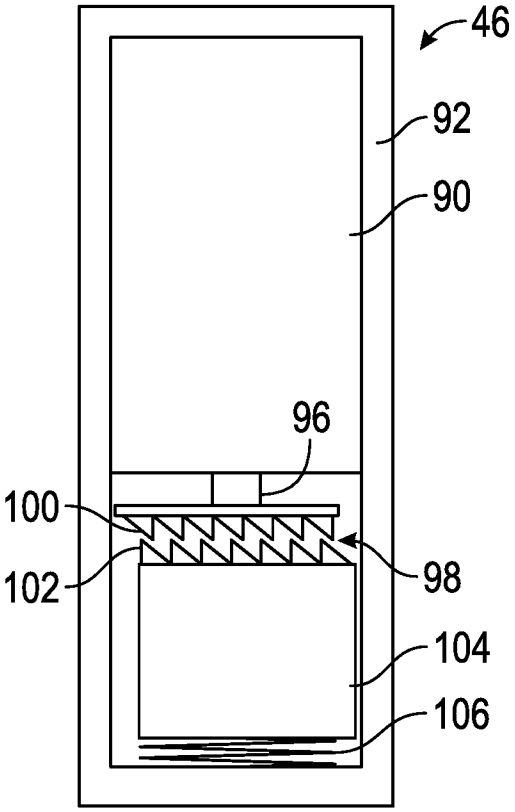
FIG. 12 is an illustration of another example of a vibrator used to apply oscillating forces to a downhole tool, according to an embodiment of the disclosure.

As illustrated in FIG. 12, the motor 90 also may be coupled to a rotatable cam mechanism 98 via shaft 96. Cam mechanism 98 comprises a cam profile 100 connected to shaft 96, and cam profile 100 is positioned to rotate against a cooperating cam profile 102 coupled to a mass 104. Rotation of cam profile 100 against cooperating cam profile 102 causes reciprocation of mass 104 against a spring 106. The movement of reciprocating mass 104 ultimately imparts the oscillating forces 54 against downhole tool 40.

Figure 13:
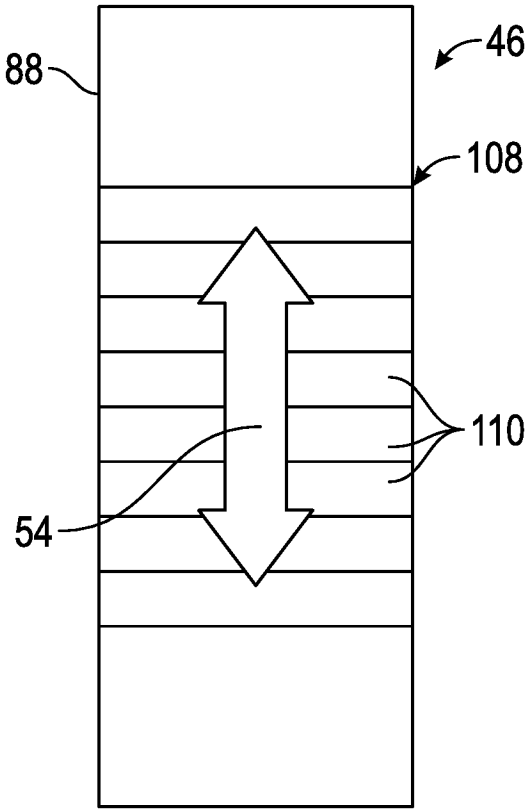
FIG. 13 is an illustration of another example of a vibrator used to apply oscillating forces to a downhole tool, according to an embodiment of the disclosure.

Referring generally to FIG. 13, another embodiment of vibrator 46 is illustrated. In this embodiment, the vibrator 46 comprises a piezoelectric mechanism 108 designed to induce the oscillating forces 54. By way of example, the piezoelectric mechanism 108 may comprise a piezoelectric stack 110 of piezoelectric devices. The piezoelectric stack 100 may be mounted in or against the tool body 88 of downhole tool 40. When electric power is applied intermittently to piezoelectric stack 110, the expansion and contraction of the piezoelectric devices forming stack 110 create the oscillating forces 54 which act against downhole tool 40.

Figure 14:
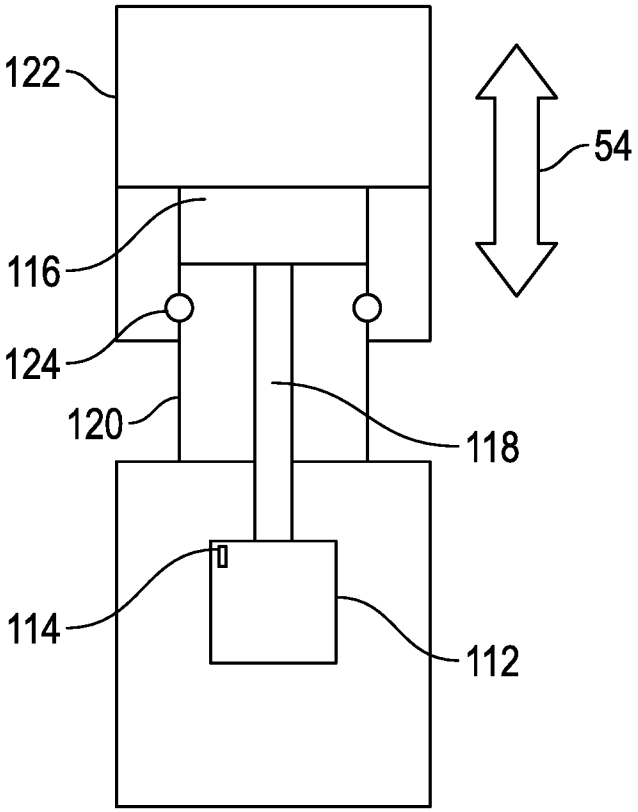
FIG. 14 is an illustration of another example of a vibrator used to apply oscillating forces to a downhole tool, according to an embodiment of the disclosure.

In FIG. 14, another example of vibrator 46 is illustrated. In this embodiment, vibrator 46 utilizes a pump 112, such as a hydraulic pump, which may be operated to initiate the oscillating forces 54. By selectively operating the pump 112 and/or appropriate valving 114, the oscillating forces 54 may be induced. By way of example, pump 112 may be operatively coupled with an accumulation chamber 116 via a hydraulic line 118. The hydraulic line 118 extends through a slide member 120 which is slidably received within a housing 122 containing accumulation chamber 116. The slide member 120 is sealed with respect to accumulation chamber 116 via a seal member 124. By alternately pumping fluid into accumulation chamber 116 via hydraulic line 118 and out of accumulation chamber 116 via valving 114, slide member 120 is reciprocated with respect to housing 122, thus causing the reciprocating or oscillating forces 54.

Figure 16:
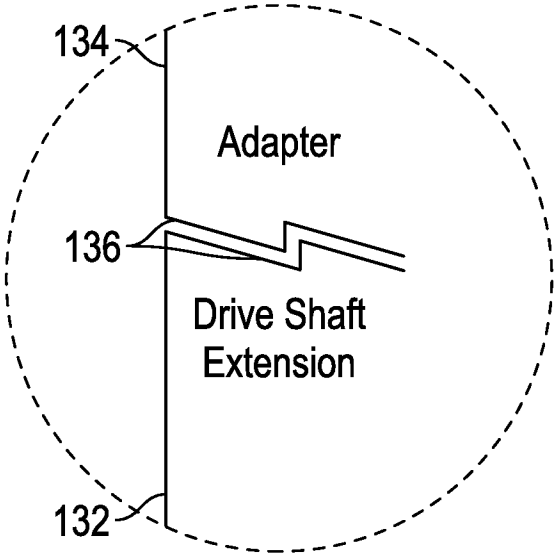
FIG. 16 is an illustration of an adapter that may be utilized with the embodiment illustrated in FIG. 15 to induce oscillating forces, according to an embodiment of the disclosure.
Figure 15:
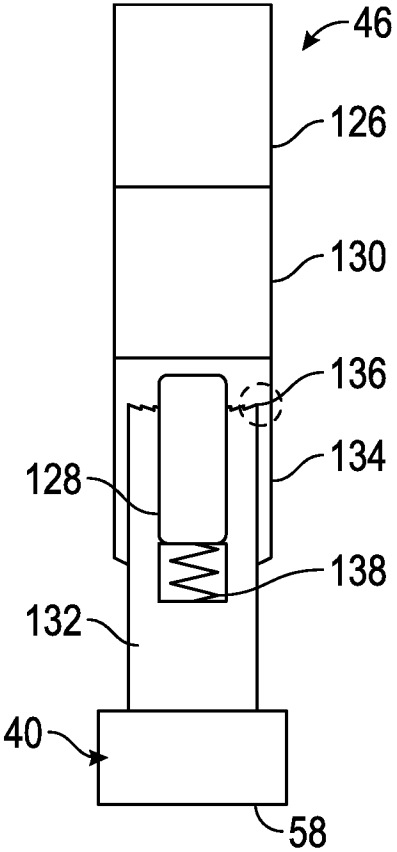
FIG. 15 is an illustration of another example of a vibrator used to apply oscillating forces to a downhole tool, according to an embodiment of the disclosure.

Referring generally to FIGS. 15 and 16, another example of vibrator 46 is illustrated. It should be noted that the various vibrators described herein are designed for use with wireline 50. In some applications, however, various embodiments of the vibrator 46, such as the embodiment illustrated in FIGS. 15 and 16, may be used with other types of conveyances 44. For example, the vibrator 46 may be used in combination with coiled tubing or other conveyances to facilitate cutting operations, such as milling or drilling operations in wellbore 42.

In the example illustrated in FIG. 15, a motor 126 rotates a driveshaft 128 via a gearbox 130. The driveshaft 128 is rotationally coupled with a driveshaft extension 132 such that they are able to rotate as unit while allowing relative axial movement. During operation of this type of vibrator 46, the driveshaft extension 132 is brought into contact with an adapter 134 via corresponding surface profiles 136 between the driveshaft extension 132 and the adapter 134 (see also FIG. 16). The surface profiles 136 are designed such that rotation of driveshaft 128 and driveshaft extension 132 causes relative rotation of profiles 136. The surface pattern of profiles 136 causes axial displacement between the driveshaft extension 132 and the adapter 134 while the profiles 136 are biased toward each other by a spring 138. The axial displacements create the oscillating forces 54 which can be used to facilitate movement of downhole tool 40. In some applications, downhole tool 40 may comprise cutting bit 58 and the oscillating forces 54 may be used to facilitate the cutting action of bit 58. The enhanced cutting may be employed to improve the rate of penetration during, for example, wireline milling or coiled tubing drilling operations. The longitudinal oscillatory forces generated against bit 58 also can be used to improve and extend the reach of the coiled tubing during coiled tubing drilling operations.

Figure 17:
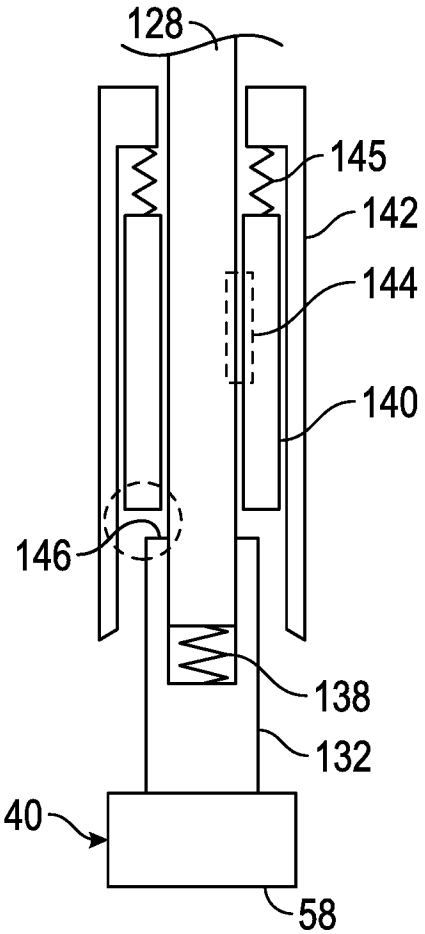
FIG. 17 is an illustration of another example of a vibrator used to apply oscillating forces to a downhole tool, according to an embodiment of the disclosure.

A similar embodiment is illustrated in FIG. 17 in which the driveshaft 128 again rotates driveshaft extension 132 while allowing relative axial movement between driveshaft 128 and driveshaft extension 132. Spring 138 may again be positioned between the driveshaft 128 and driveshaft extension 132. In some embodiments, the driveshaft extension 132 is coupled directly to downhole tool 40 which may comprise cutting bit 58. In this example, a shuttle 140 is placed between the drive shaft 128 and an outer mandrel 142. The shuttle 140 is designed to slide axially with respect to the outer mandrel 142 while being prevented from rotating with respect to outer mandrel 142. Additionally, the shuttle 140 is engaged with the driveshaft 128 via an indexer 144, such as a J-slot mechanism. The indexer 144 is designed so that as the driveshaft 128 rotates, the shuttle 140 is moved in an axially reciprocating manner with respect to the outer mandrel 142. The indexer 144 may be arranged so that when the shuttle 140 is in the highest position on the illustrated embodiment, a spring member 145 biases the shuttle 140 in a downward direction to strike an impact surface 146 of driveshaft extension 132. Once the impact is delivered, continued rotation of the driveshaft 128 in cooperation with the indexer 144 moves the shuttle 140 back to its upper position to enable repetition of the impact action which induces oscillating forces 54.

Figure 18:
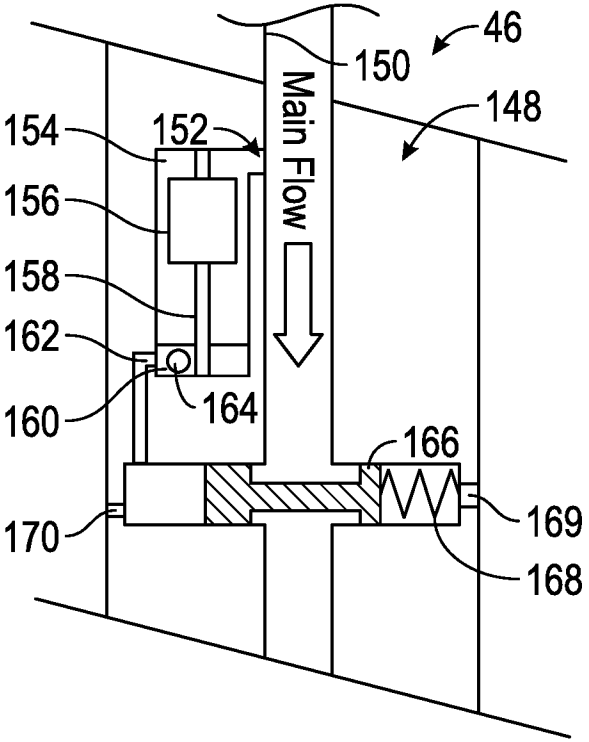
FIG. 18 is an illustration of another example of a vibrator used to apply oscillating forces to a downhole tool, according to an embodiment of the disclosure.

Referring generally to FIG. 18, another embodiment of vibrator 46 is illustrated. In this embodiment, the vibrator 46 is designed as a pressure pulse system 148. The pressure pulse system 148 may be constructed to deliver a flow of actuating fluid from a suitable surface or downhole pumping system through a main flow passage 150. A portion of the flow delivered through main flow passage 150 is routed through a port 152 and into a turbine chamber 154 which causes a turbine/gearbox system 156 to rotate. The rotation causes an output shaft 158 to drive a valve 160 in a manner which repeatedly opens and closes a port 162 and another port 164 which connects the turbine chamber 154 with a region external to downhole tool 40. The opening and closing of port 162 serves as a pilot action which selectively moves a spool valve 166 against a spring 168. Fluid flow through port 162 moves the spool valve 166 against spring 168 as fluid escapes through port 169. When flow through port 162 is closed off, spring 168 returns the shuttle valve 166 as fluid is released from port 170. This reciprocating motion of spool valve 166 opens and closes the main flow passage 150 which causes pressure pulses that are directed along the main flow passage 150 to downhole tool 40. The pressure pulses create the oscillating forces 54 which serve to facilitate desired movement of downhole tool 40.

In some applications, the pressure pulse system may be positioned at a surface location 48 and may be designed to direct pressure pulses down through the wellbore for action against downhole tool 40. Surface pressure pulse systems may be designed to improve delivery of the oscillating forces 54 by modeling of the wave propagation and/or by pulsing at an appropriate frequency and pulse width to establish a standing wave which is effective without being damaging. Additionally, modeling of the tubing forces and matching of the measured surface forces and/or downhole forces may be employed to tune the frequency and amplitude for optimum effect.

Figure 19:
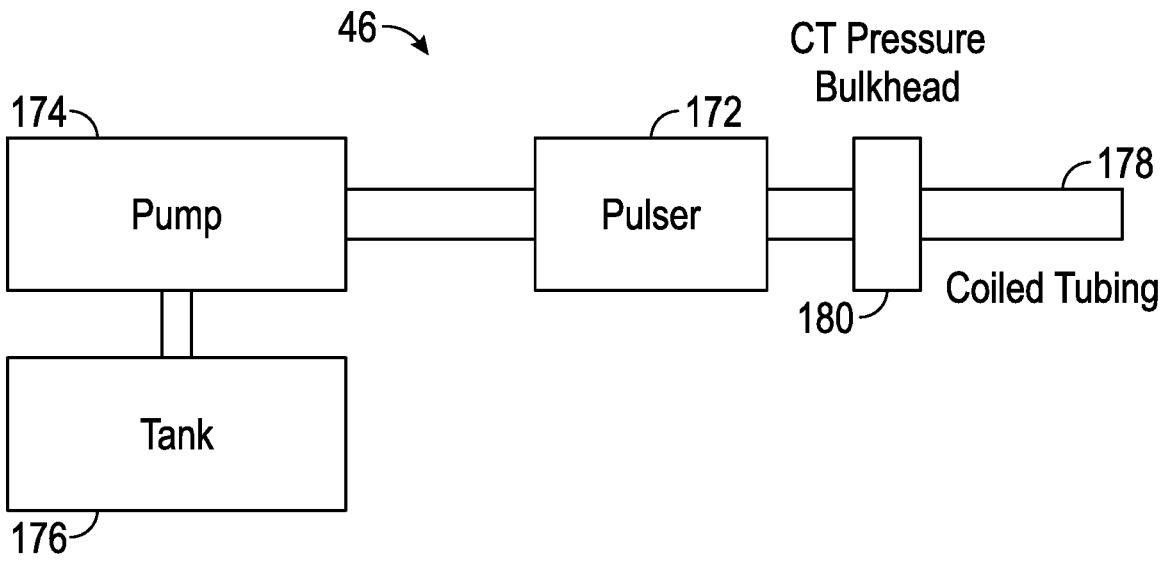
FIG. 19 is an illustration of another example of a vibrator used to apply oscillating forces to a downhole tool, according to an embodiment of the disclosure.

An example of a surface pressure pulse system is illustrated schematically in FIG. 19. In this embodiment, a pressure pulser 172 is positioned between a pump 174, which receives fluid from a supply tank 176, and coiled tubing 178. Coiled tubing 178 extends down into wellbore 42 from a coiled tubing pressure bulkhead 180. By introducing the pressure pulser 172 between the pump 174 and the coiled tubing 178, pressure pulses may be generated and propagated through fluid in coiled tubing 178 and toward a downhole end of the coiled tubing 178 for action against downhole tool 40.

Figure 20:
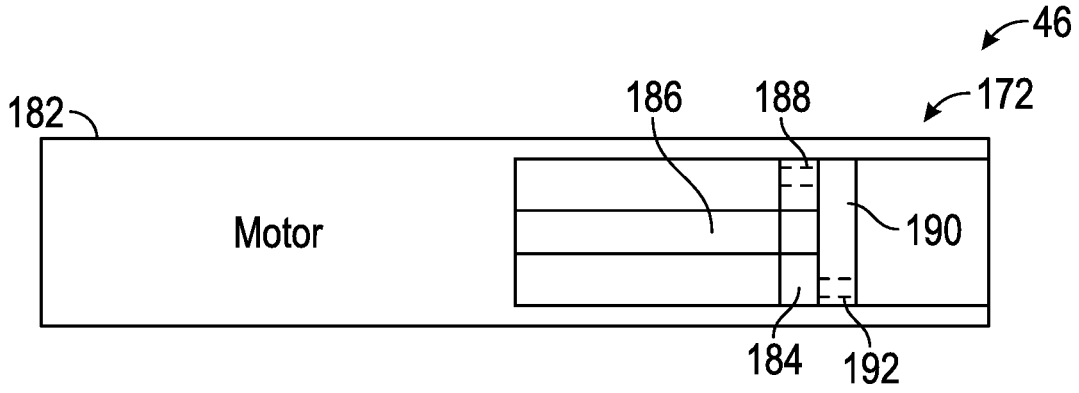
FIG. 20 is an illustration of another example of a vibrator used to apply oscillating forces to a downhole tool, according to an embodiment of the disclosure.

Surface pressure pulser 172 may have a variety of configurations. For example, the pressure pulser 172 may comprise a motor 182 driving a rotating plate 184 via a driveshaft 186, as illustrated in FIG. 20. The rotating plate 184 comprises a number of openings 188 which are rotated along a matching plate 190. The adjacent, matching plate 190 also comprises a plurality of openings 192. When plate 184 is rotated and the openings 188 are aligned with openings 192 of plate 190, fluid delivered by pump 174 passes through the pulser 172 without restriction. However, when the openings 188 and 192 are out of alignment, fluid flow through the pulser 172 is restricted and a pressure pulse is generated.

Continued rotation of plate 184 with respect to plate 190 while pump 174 is operated causes the continued creation of pressure pulses which may be delivered downhole through coiled tubing 178 to establish the oscillating forces 54 which act against downhole tool 40. By way of example, motor 182 may comprise an electrical motor, a hydraulic turbine, a PDM (positive displacement mud motor), or another suitable type of motor. It should be noted that the pressure pulser 172 illustrated in FIG. 20 may be positioned at a downhole location and controlled via communication lines along the wireline 50 or along another type of conveyance 44.

Figure 21:
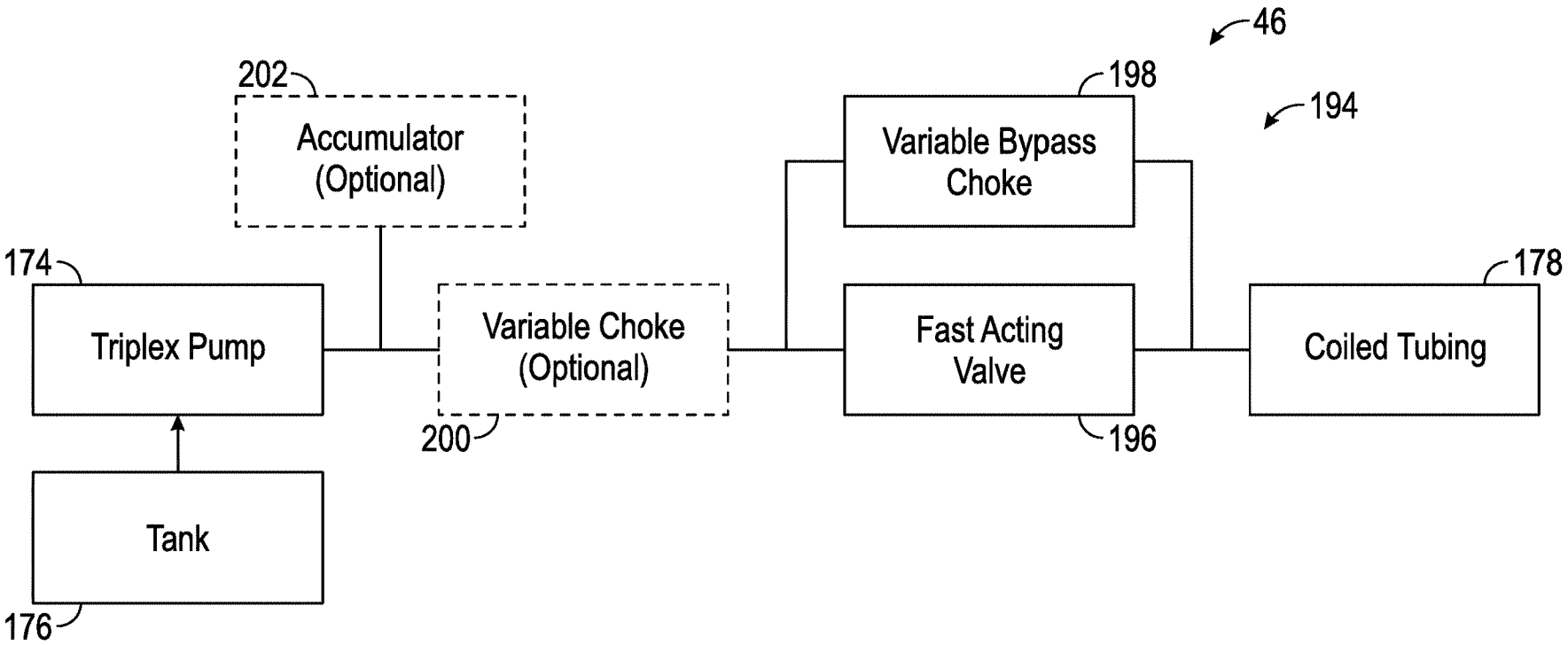
FIG. 21 is a schematic illustration of a system that may be used to induce oscillating forces, according to an embodiment of the disclosure.

Referring generally to FIG. 21, a schematic illustration is provided of a positive pressure pulse system which provides pressure pulses from a surface location while incorporating a bypass. In this example, pump 174, e.g. a triplex pump, draws fluid from tank 176 and delivers the fluid to a pressure pulser system 194 comprising a fast acting valve 196 and a variable bypass choke 198 which are operated in cooperation to create pressure pulses that may be delivered downhole through coiled tubing 178. The bypass 198 provides greater control over the interruption of fluid flow through the fast acting valve 196 by allowing some fluid to bypass the fast acting valve 196. In this example, an optional variable choke 200 may be located between pump 174 and fast acting valve 196. Additionally, an optional accumulator 202 may be located between pump 174 and fast acting valve 196.

Figure 22:
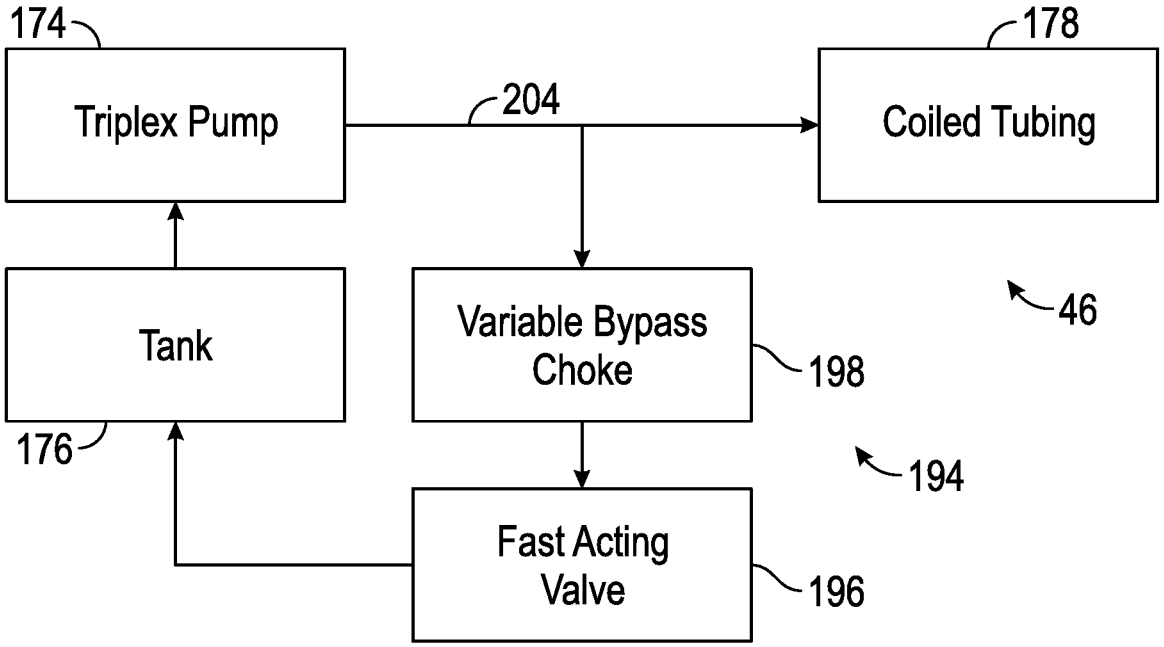
FIG. 22 is a schematic illustration of another system that may be used to induce oscillating forces, according to an embodiment of the disclosure.

In FIG. 22, a schematic illustration is provided of a similar pressure pulse system which may be used to deliver pressure pulses from a surface location. However, this embodiment differs from the embodiment illustrated in FIG. 21 because the pressure pulse system 194 (with fast acting valve 196 and variable bypass choke 198) is positioned to selectively vent the pump pressure from a pump output line 204 in fluid communication with coiled tubing 178. When the fast acting valve 196 is opened, fluid is vented to tank 176 and the pump pressure is reduced, thus creating a pressure pulse delivered down through coiled tubing 178 to downhole tool 40. The variable bypass choke 198 may again be operated to adjust the pressure pulse magnitude.

Figure 23:
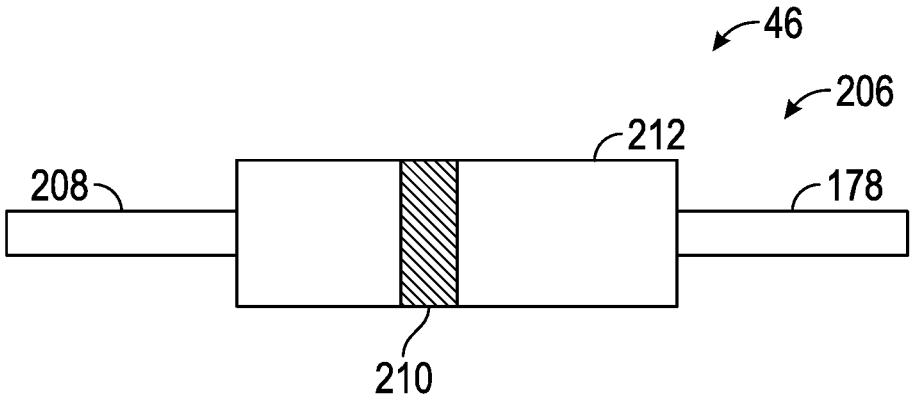
FIG. 23 is an illustration of another example of a vibrator used to apply oscillating forces to a downhole tool, according to an embodiment of the disclosure.

Referring generally to FIG. 23, a pressure pulse device 206 is illustrated and is designed to operate on variable pressure source fluid delivered from an upstream location, such as a surface location. Depending on the specific application, the pressure pulse device 206 may be located at a surface location or at a suitable downhole location to receive variable pressure source fluid from, for example, pressure pulse system 194. The variable pressure source fluid is delivered to pressure pulse device 206 via an appropriate conduit 208, such as a well tubing. By way of example, pressure pulse device 206 may comprise a movable member 210, such as a piston or bellows, movably mounted within a surrounding housing 212. The variable pressure source fluid delivered through conduit 208 causes pulsing of the movable member 210 which, in turn, amplifies or otherwise induces a desired pulsing characteristic to the fluid passing through conduit 208, member 210, and housing 212 and flowing into coiled tubing 178. In an embodiment, the fluid in the conduit 208 and in that portion of the housing 212 adjacent the conduit 208 is separate from the fluid in the coiled tubing 178 and in that portion of the housing 212 adjacent the coiled tubing 178. The pulsing fluid directed through coiled tubing 178 serves to provide the oscillating forces which can be directed to act against downhole tool 40, e.g. cutting bit 58. The movable member 210 may be spring biased in a given direction to return the movable member 210 and to enhance the pulsing effect.

Figure 24:
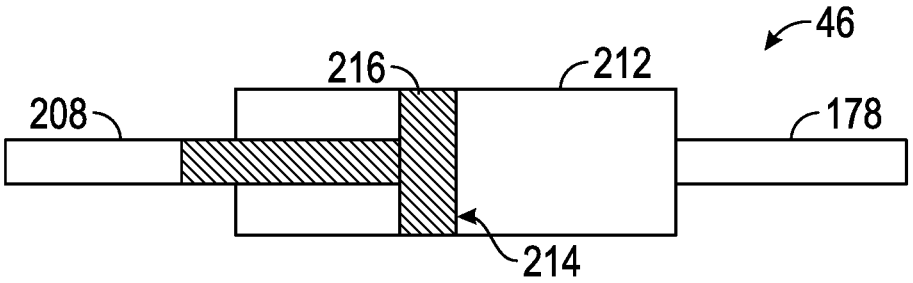
FIG. 24 is an illustration of another example of a vibrator used to apply oscillating forces to a downhole tool, according to an embodiment of the disclosure.

In FIG. 24, a similar embodiment of pressure pulse device 206 is illustrated. However, movable member 210 has been replaced with an intensifier piston 214 which is slidably received in conduit 208. The intensifier piston 214 also comprises an expanded portion 216 which is slidably and sealably mounted within housing 212. As with the embodiment utilizing movable member 210, variable pressure source fluid is delivered through conduit 208. The variable pressure source fluid causes pulsing of the intensifier piston 214 which, in turn, amplifies or otherwise induces a desired pulsing characteristic to the fluid passing through conduit 208 and housing 212 and flowing into coiled tubing 178. In an embodiment and similar to that described in FIG. 23, the fluid in the conduit 208 and in that portion of the housing 212 adjacent the conduit 208 is separate from the fluid in the coiled tubing 178 and in that portion of the housing 212 adjacent the coiled tubing 178. The pulsing fluid directed through coiled tubing 178 serves to provide the oscillating forces which can be directed downhole to tool 40. The piston 214 may be spring biased in a given direction to return the piston 214 and to enhance the pulsing effect.

Figure 25:
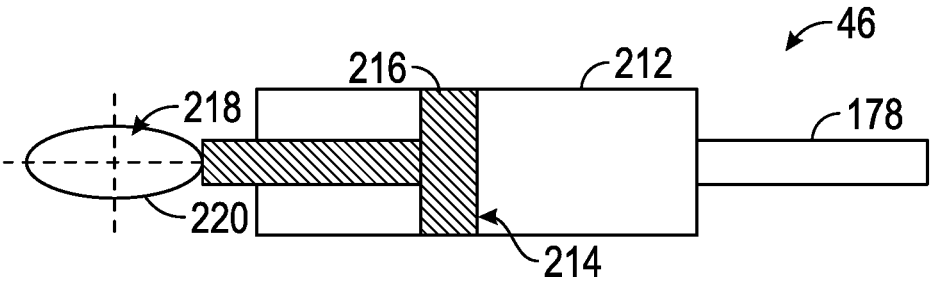
FIG. 25 is an illustration of another example of a vibrator used to apply oscillating forces to a downhole tool, according to an embodiment of the disclosure.

In FIG. 25, another embodiment of pressure pulse device 206 is illustrated. In this embodiment, the intensifier piston 214 is acted on by a mechanical device 218 instead of variable pressure source fluid supplied through conduit 208. By way of example, the mechanical device 218 may comprise a cam 220 operated by a motor or other suitable motive unit. For example, cam 220 may be driven by a hydraulic or electric motor coupled to the cam directly or through a slider-crank mechanism. As illustrated, the cam 220 is positioned against piston 214 in a manner which causes piston 214 to oscillate. In an embodiment and similar to that described in FIGS. 23 and 24, the fluid in the conduit 208 and in that portion of the housing 212 adjacent the conduit 208 is separate from the fluid in the coiled tubing 178 and in that portion of the housing 212 adjacent the coiled tubing 178. In some applications, the piston 214 may be spring biased against cam 220 to facilitate the oscillating movement. The cam 220 causes pulsing of the intensifier piston 214 which, in turn, amplifies or otherwise induces a desired pulsing characteristic to the fluid passing into coiled tubing 178 from a suitable fluid supply conduit, e.g. conduit 208. The pulsing fluid directed through coiled tubing 178 serves to provide the oscillating forces which act against downhole tool 40.

As described herein, the devices and systems used to create the oscillating forces 54 may have a variety of configurations and may be designed to deliver a variety of oscillating forces. For example, the propagation of forces to the downhole tool 40 may be through direct impact or through reaction with other components or systems. The direction of the oscillating forces may be longitudinal, orthogonal, torsional, or various combinations of these forces. The vibrator mechanisms used to provide the oscillating forces may be hydraulic, mechanical, electromechanical, e.g. electromagnetic, other types of mechanisms, or various combinations of these mechanisms. With electromagnetic mechanisms, the magnetic flux direction may be transverse, longitudinal, or oriented in another suitable direction. The various mechanical and/or electromechanical arrangements may comprise motors combined with cams, eccentric masses, hydraulic systems, piezoelectric systems, and other suitable systems. Electromechanical systems utilizing stators may be designed with inner stators or outer stators to induce appropriate oscillations and resulting oscillating forces. The vibrator mechanisms also may be selectively controlled to deliver the oscillating forces with varying frequencies and/or varying amplitudes by controlling the electrical power, the mechanical power, and/or the hydraulic power supplied to the mechanisms.

Depending on the parameters of a given application, the various pulsing devices and systems described herein may be combined with wireline and many of those systems may be deployed downhole with the downhole tool 40. In some applications, the inducement of oscillating forces may be accomplished by surface devices which deliver hydraulic pulses or other types of oscillating forces downhole to a desired location. Although many of the embodiments described herein are very useful with wireline deployed tools, at least some of the embodiments may be used with coiled tubing or other conveyances. Additionally, the systems and methodology for creating the oscillating forces may be used with a variety of downhole tools to facilitate and enhance movement of the tool at a downhole location.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for providing oscillations downhole, comprising:

coupling a tool and a vibrator to a conveyance, the vibrator having a vibrating mass disposed about a stator;

moving the conveyance, the tool, and the vibrator downhole into a wellbore;

operating the vibrator to free the tool from a stuck position within the wellbore by creating oscillating forces acting on the tool; and applying a pull force to the conveyance from surface.

2. The method as recited in claim 1, wherein operating comprises creating oscillating forces oriented in an axial direction with respect to the wellbore.

3. The method as recited in claim 1, wherein operating comprises creating oscillating forces oriented in an orthogonal direction with respect to the wellbore.

4. The method as recited in claim 1, wherein operating comprises creating oscillating forces that exert torsional vibrating forces.

5. The method as recited in claim 1, wherein operating the vibrator comprises creating the oscillating forces with a plurality of conductive coils.

6. The method as recited in claim 1, wherein the tool comprises sensors for gathering measurements of the tool and/or the vibrator and further comprising utilizing the measurements to optimize performance and/or operation of the tool and/or vibrator.

7. The method as recited in claim 1, further comprising varying a frequency of the oscillating forces to adjust the forces applied by the tool.

8. The method as recited in claim 1, wherein the stator comprises a conductive coil and the vibrating mass comprises a magnet to create the oscillating forces.

9. A system for providing oscillations downhole, comprising:

a downhole tool;

a vibrator having a vibrating mass disposed about a stator and between springs; and a conveyance coupled to the downhole tool and the vibrator, the vibrator being positioned to create oscillating forces that act on the downhole tool.

10. The system as recited in claim 9, wherein the vibrator is connected to the downhole tool for operation at a downhole location.

11. The system as recited in claim 9, wherein the vibrator comprises an electromechanical actuator.

12. A method for providing oscillations downhole, comprising:

conveying a tool downhole with a conveyance;

operating the tool at a downhole location to perform a function;

providing additive forces to the tool by creating oscillating forces with a vibrating mass disposed about a stator that vibrate the tool to free the tool from a stuck position;

adjusting a frequency or amplitude of the oscillating forces to adjust the forces applied to the tool; and applying a pull force from surface to the conveyance.

13. The method as recited in claim 12, wherein further comprising gathering measurements from at least one sensor on the tool, and wherein adjusting comprises adjusting the operation of the tool and/or oscillating forces based on the measurements.

14. The method as recited in claim 12, wherein the stator comprises a conductive coil and the vibrating mass comprises a magnet to create the oscillating forces.

* * * * *